United States Patent [19]

Elkins, Jr.

[11] 4,193,757

[45] Mar. 18, 1980

[54] FURNACE CONSTRUCTION AND METHODS OF LOADING AND SEALING A COMBUSTION CHAMBER THEREIN

[75] Inventor: Samuel R. Elkins, Jr., Chamblee, Ga.

[73] Assignee: Electro Minerals, Inc., Lawrenceville, Ga.

[21] Appl. No.: 927,292

[22] Filed: Jul. 24, 1978

[51] Int. Cl.[2] ..... F27D 1/16; F27D 1/00; H05B 7/18

[52] U.S. Cl. ..... 432/3; 13/9 R; 13/34; 13/35; 432/247

[58] Field of Search ..... 13/9, 34, 35; 432/4, 432/241, 247, 3

[56] References Cited

U.S. PATENT DOCUMENTS

| | | | |
|---|---|---|---|
| 1,212,390 | 1/1917 | Ordway | 432/247 |
| 1,255,066 | 1/1918 | Tharaldsen | 13/9 |
| 2,026,370 | 12/1935 | Winkler | 432/241 |
| 4,080,508 | 3/1978 | Greenewald | 13/9 X |

*Primary Examiner*—John J. Camby
*Attorney, Agent, or Firm*—Richard P. Matthews

[57] ABSTRACT

A furnace construction capable of withstanding temperatures in excess of 3500° F. A uniquely suspended floor structure permits thermal expansion to occur as required within the furnace while permitting the admission of a cooling fluid to metal plate members therewithin. The furnace chamber is provided with an open bottom which is closed with a refractory raw material in a container and sealed by a skirt member attached directly to the superstructure of the furnace which penetrates the refractory material. Track and elevation means permits the refractory filled loaded container to be pushed into position and lifted until it seals the furnace chamber and the refractory material is heated above its melting point to form a fused ingot. Thereafter, the fused ingot is lowered in the container onto the track means and pushed away while another container of raw material is pushed into position.

19 Claims, 5 Drawing Figures

FURNACE CONSTRUCTION AND METHODS OF LOADING AND SEALING A COMBUSTION CHAMBER THEREIN

BACKGROUND OF THE INVENTION

This invention relates to a furnace construction having a suspended, readily expandable floor structure capable of withstanding temperatures in excess of 3500° F. and, more particularly, to such a furnace structure having a unique method of sealing its furnace chamber and a novel method of loading and unloading the furnace with a refractory material.

Heretofore, a substantial difficulty has been experienced in building and maintaining furnaces wherein the operating temperatures exceeded 3500° F. principally because of the scarcity of insulating materials that will withstand these temperatures. In practical terms, the choice of materials has come down to two principal materials, namely, carbon in the form of graphite carbon block or carbon black, and magnesium oxide (MgO). Unfortunately, magnesium oxide readily fluxes and vaporizes at temperatures of these magnitudes in the presence of $SiO_2$ and most other oxides and contaminates the ingots produced in these furnaces. Therefore, it is desirable to be able to construct a furnace for making refractory ingots which will not use magnesium oxide to obtain its structural integrity and insulating capability.

A second major problem in operating furnaces at such high temperatures is that of controlling the expansion of the internal members which define the furnace chamber so that they will not fail due to thermal expansion mismatch or binding during thermal expansion.

Difficulties in sealing the furnace chamber and in loading and unloading furnaces at such high operating temperatures also exist which, of course, directly affect the thermal efficiency and thereby the cost of operating such furnaces.

SUMMARY OF THE INVENTION

In accordance with the present invention, the foregoing difficulties and problems have been effectively overcome. In particular, a furnace is provided which eliminates the use of magnesium oxide as a part of the inner structure of the furnace thereby removing a major contaminant from the end product. In its place, the major walls of the furnace chamber are made from graphite and unique use of charred paper is made as an insulating material exteriorly of the furnace chamber.

The problem of excessive expansion of the furnace chamber and the support therefor is effectively overcome by the use of a novel floor construction having readily expandable metal plate members. In addition, each component of the furnace chamber itself is arrange and supported in a manner permitting each member to expand readily. A cooling liquid is introduced into the floor structure to help limit the expansion of the metal plate members.

The furnace chamber itself is provided with an open bottom structure and $SiO_2$ or other refractory oxide which is to be melted or fused is used to seal the bottom of this furnace chamber. In a preferred embodiment, the raw material is carried in a container on a raw material feeder transported on track means. The container on the raw material feeder is pushed or otherwise moved to a position beneath the open bottom of the furnace chamber and ifted upwardly sufficiently far to establish a seal by means of a downwardly extending skirt member from the superstructure of the furnace. An electric arc is drawn in the furnace chamber by initially shorting and then separating two graphite electrodes. The heat from the furnace chamber establishes a positive pressure within the furnace chamber. A series of vents each of which has a weighted flap member insures that a slight positive pressure is maintained within the furnace.

After an ingot has been formed within the container, the feeder and the container are lowered onto the track means therebeneath and pushed out from beneath the furnace while another container on its feeder is being pushed into position beneath the furnace chamber. The transfer time according to this method is quite efficient in the order of magnitude of fifteen seconds.

The inherent advantages and improvements of the present invention will become more readily apparent upon reference to the detailed description of the following preferred embodiment and by a consideration of the accompanying drawings.

DETAILED DESCRIPTION OF A PREFERRED EMBODIMENT

Figure 1:
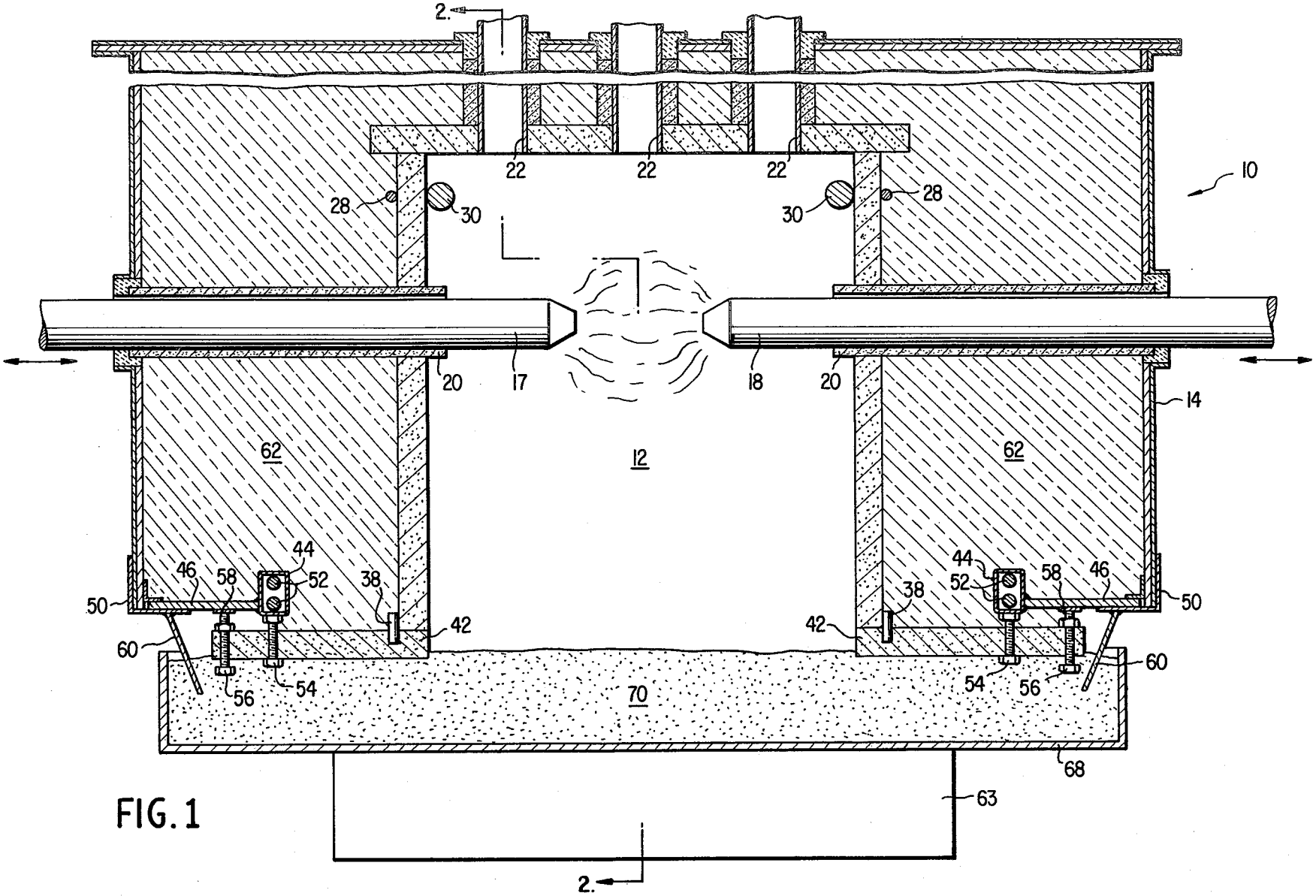
FIG. 1 is a front elevational view, taken in vertical cross section with portions broken away, showing the furnace structure of the present invention and a raw material feeder therefor.
Figure 2:
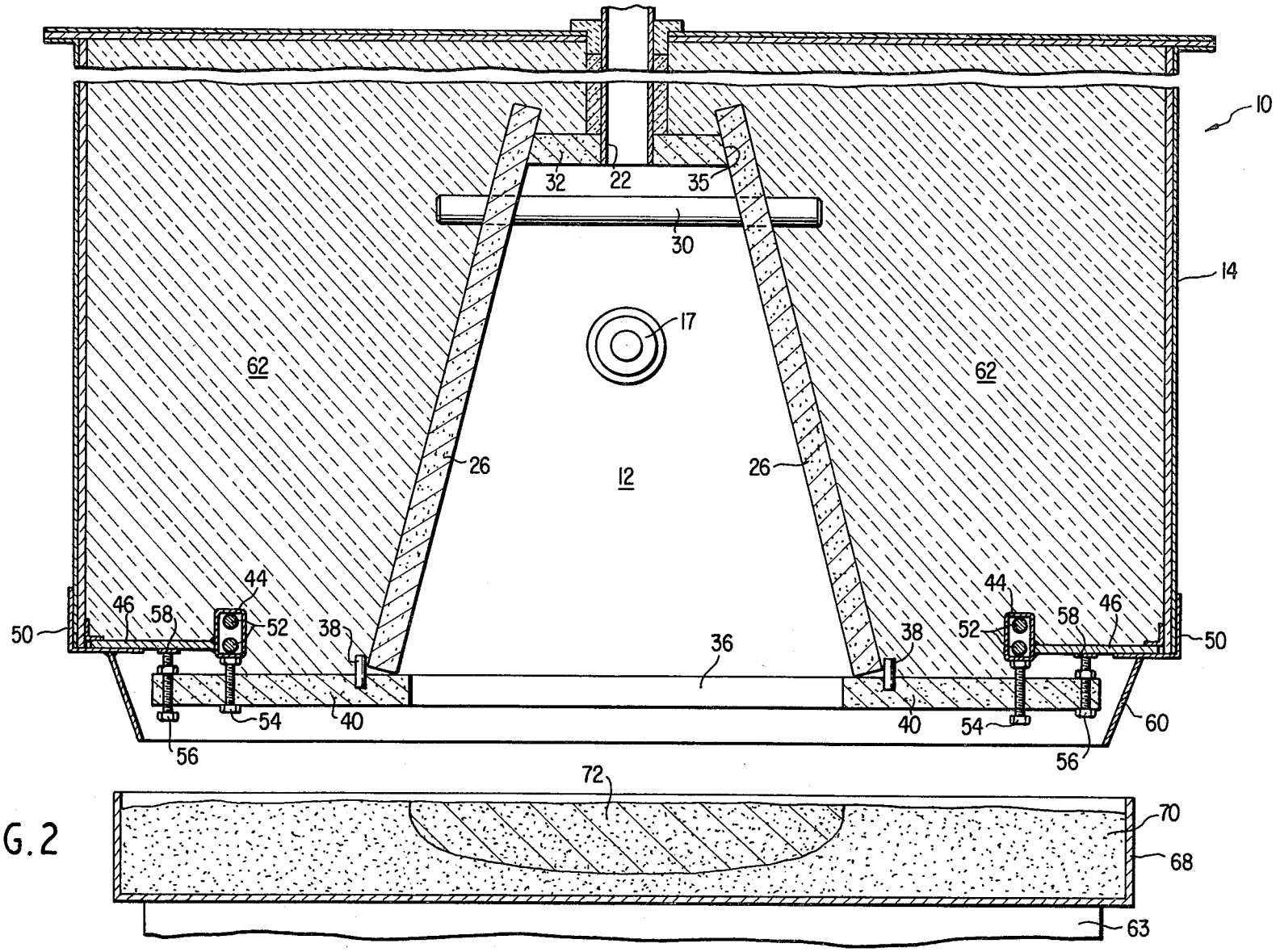
FIG. 2 is an elevational view taken in vertical cross section along line 2—2 of FIG. 1.

Referring now to FIGS. 1 and 2 of the drawings, there is illustrated a furnace, indicated generally at 10, having a centrally located furnace chamber 12 located therein. A superstructure 14 of the furnace is supported above the ground by vertical support members 15 and horizontally extending support members 16 shown in 4 FIG. 4. A pair of reciprocable electric arc electrodes 17, 18 are supported within sleeves 20 to establish an electric arc within the furnace chamber 12. The electrodes are initially brought into contiguous relationship and then separated to establish an electric arc therebetween to heat and melt a refractory material 70 into a refractory ingot. The furnace chamber 12 is vented by a series of tubular vents 22.

Figure 3:
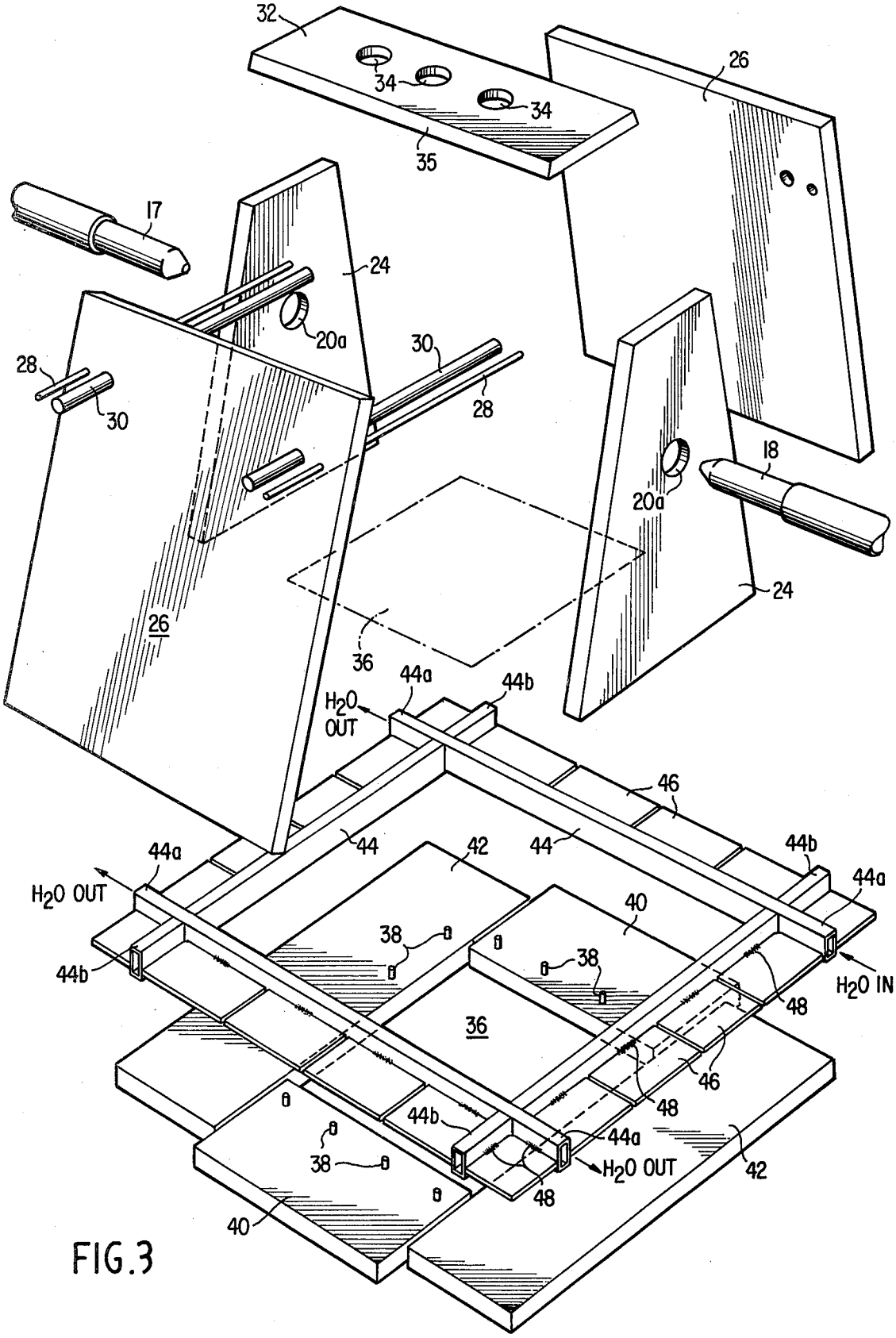
FIG. 3 is an exploded view illustrating the interior floor, wall and ceiling arrangement for the furnace of FIG. 1.
Figure 5:
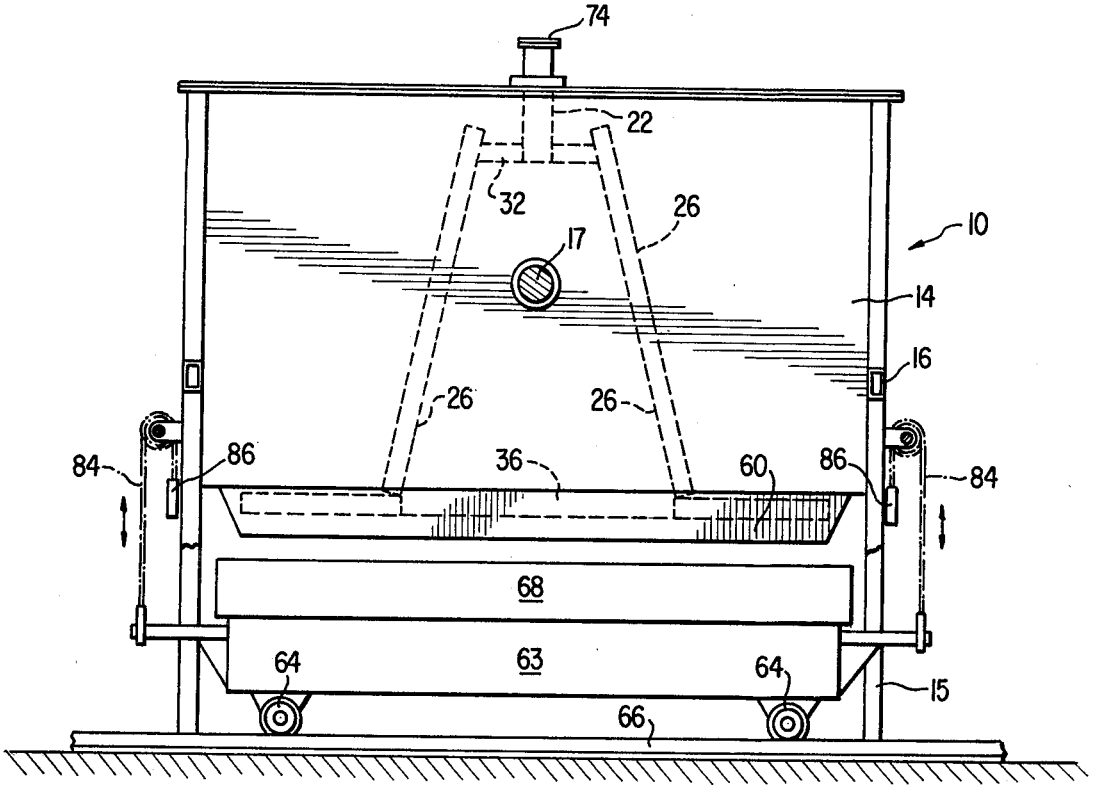
FIG. 5 is a front elevational view taken along line 5—5 of FIG. 4.

Referring now to FIG. 3, there is illustrated an exploded view of the members constituting the furnace chamber and the expandable floor for the furnace. Thus the furnace chamber 12 comprises a pair of opposed vertically-disposed side wall members 24 and a pair of slanting side wall members 26. The relative position for the two pair of walls is illustrated best in FIGS. 2 and 5 and this position is maintained by the use of outer rods 28 and inner rods 30 disposed on opposite sides of the vertical side walls 24 and passing through apertures provided in side walls 26. A top wall member 32 is placed atop the pair of vertical side wall members 24 and may be pinned to one of them. The top wall 32 has vent apertures 34 to receive the vents 22 and a pair of beveled edges 35 so as to fit snugly within the pair of slanting side wall members 26 in the manner illustrated in FIG. 2. The furnace chamber 12 further has a centrally disposed aperture 36 formed at the bottom thereof.

Pin members 38 deposited in countersunk holes in two pairs of graphite members 40, 42 which form the main floor of the furnace are provided to limit the outward movement of the bases of the two pair of side wall members 24, 26 during operation.

A plurality of tubular steel support members 44 form a generally rectangular structure as illustrated in FIG. 3. Metal plate members 46 are attached to the tubular support members 44 by welds at 48 and the plate members 46 cooperate with the tubular support members 44 to suspend the two pair of main floor members 40 and 42. In particular, the metal plate members 46 being attached only at a single point to the tubular support members 44 are free to move in all directions in that they are spaced on each lateral side from the adjacent metal plate member 46. The four end plate members are doubly attached by welding to the tubular support members in each of the corners.

As illustrated in FIGS. 1 and 2, the plate members 46 rest on an angle support 50 of the superstructure and are thereby suspended. The tubular support members 44 have four open ends at 44a whereby water or other cooling means may be pumped into one of the hollow tubular portions of the support members 44 and water exited from the remaining three open ends 44a of the tubular support members. The ends at 44b are closed to facilitate this flow of coolant. Solid rods 52 are provided within the tubular support members 44 through which the coolant traves.

In order to suspend the main floor members 40, 42 a plurality of nut and bolt assemblies 54 extend through the graphite floor member 40 and 42 in FIG. 1 and abut against the bottom of the tubular support member 44, Approximately three such nut and bolt assemblies 54 are used along the length of floor members 40 and approximately four assemblies 54 along the length of each floor member 42. Adjustment and leveling of the floor is provided by the conjunctive use of another plurality of nut and bolt assemblies 56 which bear against wear plates 58 in the metal plate members 46. By using a plurality of pairs of nut and bolt assemblies 54,56 for each floor member 40, 42 it becomes possible not only to suspend the floor members but also to achieve a level floor. The angle 50 is provided with a downwardly and inwardly extending depending skirt member 60 which extends peripherally around the underside of the entire furnace floor in order to effect a seal of the bottom of the furnace chamber as will be explained more fully hereinafter.

The furnace 10 includes the use of charred paper 62 exteriorly of the main furnace chamber 12 and within the superstructure 14 of the furnace. The method of making this charred paper is to use black newsprint, not colored since it contains too much clay, which is spread open and put in a furnace on a clay floor. Sand is placed on top of the newsprint so as to exclude air and the furnace containing the newsprint is heated to a temperature, such as 1800° F., overnight. Then the newsprint is permitted to cool slowly to room temperature while excluding air therefrom. This charred paper product is then ready for use as an insulation material within the furnace exteriorly of the main furnace chamber 12. The charred paper is sealed in place by a blanket-like insulating material known as Kaowoll which is spread on the floor members 40, 42 and plate members 46 and lines the interior of the furnace 10.

Figure 4:
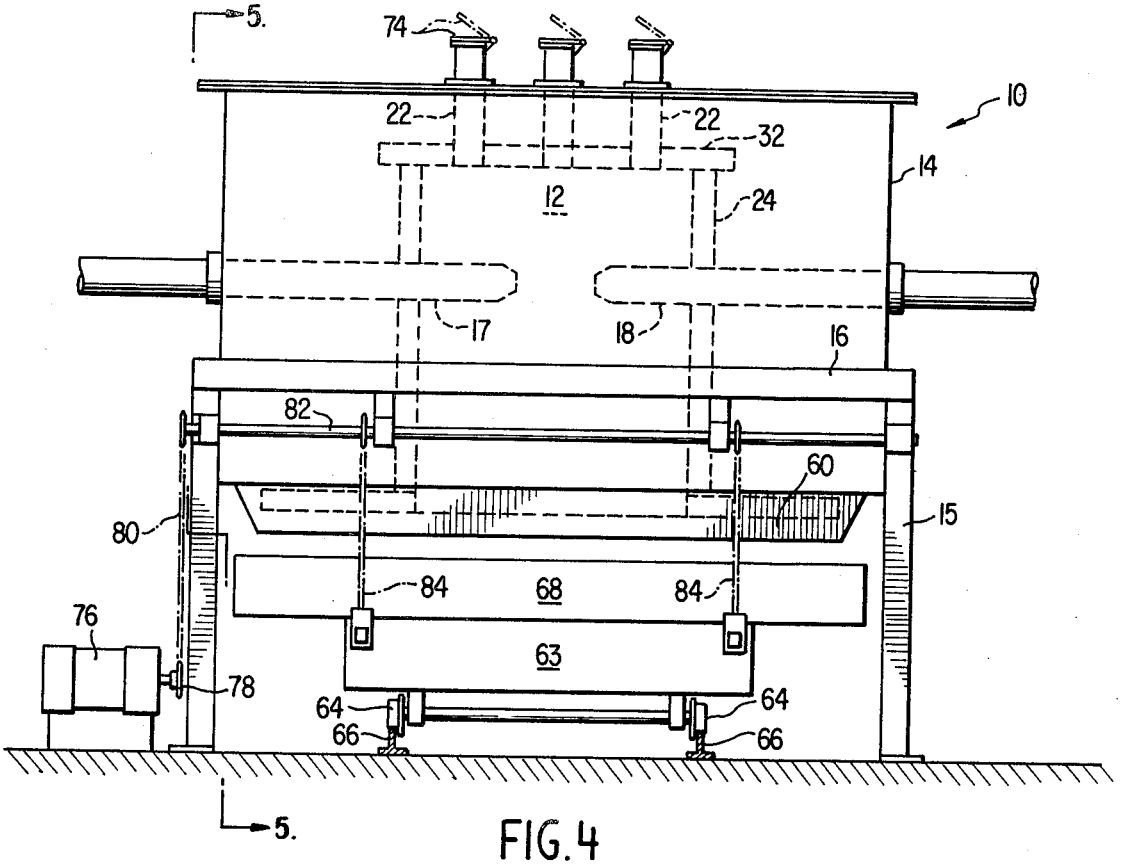
FIG. 4 is an end elevational view illustrating the furnace of FIG. 1 and a drive means for raising and lowering the raw material feeder therefor.

A raw material carrier car or feeder is illustrated at 63 in FIG. 4 which carries the raw material into position beneath the bottom of the main furnace chamber 12. The raw material carrier car 63 is provided with wheels as shown at 64 in FIGS. 4 and 5 and it runs on track means 66 beneath the furnace. The raw material carrier car 63 carries a container 68 for the raw material which may be sand 70 or other refractory materials. FIG. 2 illustrates at 72 an ingot produced in the center of the raw material 70 within container 68 after the electric arc has been applied within the furnace chamber 12.

The vents 22 are provided with weighted flaps 74 so as to maintain a positive pressure within the furnace 12. This insures that air from outside the furnace will not seep into the furnace.

A motor drive is shown at 76 in FIG. 4, the output shaft of which carries a sprocket 78 which advances a chain 80 and thereby turns shaft 82 to which connected chains 84 leading to the raw material carrier car 63. A counterweight is shown at 86 to maintain tension within the chain 84 and permit rotation of shaft 82 to lift the raw material carrier car 63 and container 68 until the latter is raised sufficiently far to embed the depending skirt member 60 within the raw material 70 and effect a seal of the bottom of furnace 12. After the ingot has been formed at 72, the raw material carrier car 63 is lowered into the track 66 and the car is pushed from beneath the furnace while another car containing raw material is pushed into position beneath the opening in the bottom of furnace 12. In this manner, an efficient changeover can be made for the furnace of a total elapsed time of approximately 15 seconds.

As can be seen from a study of FIGS. 1 and 4, the electrodes 17 and 18 are originally brought into touching relationship and then are separated as an arc is drawn therebetween establishing a positive pressure within furnace chamber 12. Weights are added onto the flaps 74 of vents 22 until there is an assurance that a positive but slight pressure exists within furnace 12. This positive pressure is maintained throughout the heating step and formation of an ingot 72 within the container 68. It is necessary to seal the furnace from air because graphite will oxidize and the only air which is permitted in the furnace is that which is entrapped within the sand or other raw material. All magnesium oxide or any other refractory has been excluded and it has been replaced with graphite and charred paper 62. The superstructure itself is cooled with water as are the metal plate members 46 by the introduction of water within the tubular support members 44.

The electrodes are initially shorted out and then separated to draw an arc with the length of the arc being a function of the power. A typical voltage is in the order of 130 –150 volts and an amperage of about 2000 amps. The positive pressure is maintained within the furnace so as to repel air therefrom.

Once the furnace is hot, it is maintained hot in order to achieve thermal efficiency. Gases are removed from the furnace chamber by passing through the electrode sleeves 20 and vents 22. The height of the electrodes above the sand is a function of the power input and it has been found that a distance of more than 10½ inches but less than 22 inches is required. In the sealing of the shield 60 within the sand, if a proper seal is not established gases will bubble out of the sand indicating to the operator that it is necessary to embed the depending skirt further into the sand to effect a complete seal.

A number of materials can be used as the raw material for making ingots in the furnace of the present invention. These include silica, silica foam, clay foam, mullite (silica alumina), alumina ($Al_2O_3$), and zirconia ($ZrO_2$).

Graphite used in the furnace will withstand temperatures of 6000° F. By venting in a direction away from the sand, impurities are carried away from the ingot. Impurities have been found on the vents which were not present on the surface of the ingot and it is possible in accordance with the present invention to obtain ingots which are, in fact, of a higher state of purity than the original raw material. The metal structure is maintained cool so as to eliminate warping and twisting. Approximately every sixty days, the furnace is disassembled and the graphite members replaced.

While a presently preferred embodiment of the invention has been illustrated and described, it will be recognized that the invention may be otherwise variously embodied and practices within the scope of the claims which follow.

What is claimed is:

1. A furnace construction capable of withstanding temperatures in excess of 3500° F. which comprises:

a. means defining a centrally located furnace chamber, b. means defining an external chamber surrounding said central chamber with said external chamber being substantially filled with heat insulation means, c. said means defining said centrally located furnace chamber including graphite side wall and top wall members, d. said central chamber having an open bottom wall adapted to be closed by the material to be heated, e. a removable container member for holding the material to be heated capable of being positioned beneath the open bottom wall, f. sealing means including a depending skirt member extending downwardly from the superstructure of said furnace adapted to effect a seal with the material within said removable container member, g. means for drawing an electric arc within said furnace chamber, h. and means for maintaining a positive pressure within said furnace chamber.

2. A furnace construction as defined in claim 1 including track means passing beneath the open bottom of said centrally located furnace chamber along which the material to be heated is moved into and out of its heating position.

3. A furnace construction as defined in claim 2 including means to lift the material to be heated up from said track means to effect closure of the bottom of said furnace chamber.

4. A furnace construction as defined in claim 1 wherein said heat insulation means filling said external chamber is charred paper.

5. A furnace construction as defined in claim 1 wherein said means for maintaining a positive pressure within said furnace chamber includes means for venting said furnace chamber.

6. A furnace construction as defined in claim 5 wherein said means for venting said furnace chamber also includes weighted flap means for closing said venting means.

7. A floor structure for a furnace capable of withstanding furnace temperatures of at least 3500°0 F. which comprises:

a. a tubular supporting frame structure, b. means for circulating a cooling fluid through said tubular supporting frame structure, c. a plurality of metal plate members constituting a shelf-like structure individually attached along a portion of one marginal edge to said tubular supporting frame structure, said metal plate members spaced from each other and having free marginal edges to permit thermal expansion of said metal plate members, d. means for supporting said metal plate members along the free marginal edges thereof, e. and a plurality of graphite floor members arranged to define a central aperture between the inner edges thereof and supported from said tubular supporting frame structure.

8. A floor structure as defined in claim 7 including leveling means extending between said graphite floor members and said metal plate members to effect leveling of said graphite floor members.

9. A floor structure as defined in claim 8 wherein said leveling means consists of screw means extending through one of said graphite floor members and additional screw means in abutment with one of said metal plate members.

10. A floor structure as defined in claim 7 including furnace chamber means comprising a first pair of side wall members supported on a first opposed pair of graphite floor members, a second pair of side wall members supported on a second opposed pair of graphite floor members and a top wall member substantially closing the opening at the top of said first and second pair of side wall members.

11. A floor structure as defined in claim 10 wherein said graphite floor members carry abutment members engageable with the bases of said side wall members to prevent outward movement of said side wall members during thermal expansion of said side wall members.

12. A floor structure as defined in claim 11 wherein said first pair of side wall members extend vertically upwardly from said first opposed pair of graphite floor members and said second pair of side wall members are slanted inwardly toward each other and are spaced apart by said top wall member.

13. A method of sealing refractory material to form refractory ingots which comprises the steps of a. providing a furnace chamber within a furnace having enclosed side wall members and a top wall member, b. arranging a group of graphite floor members with a central aperture therein, c. positioning a refractory material within a container beneath said central aperture in said graphite floor members, d. providing a downwardly extending skirt member constituting a sealing member from the superstructure of said furnace, e. and elevating said refractory containing container sufficiently far to embed said skirt member within said refractory material thereby sealing the bottom of said furnace chamber.

14. A method as defined in claim 13 including the additional step of heating said refractory material by drawing an arc between two electrodes in said furnace chamber which are spaced from said refractory material.

15. A method as defined in claim 14 including the additional step of spacing said electrodes from said refractory material by more than 10½ inches but less than 22 inches.

16. A method as defined in claim 15 including the additional step of heating said furnace chamber to a temperature of more than 3500° F.

17. A method of loading and unloading a furnace having a skirt member downwardly extending from the superstructure of said furnace and further having a furnace chamber comprising enclosed side wall members and a top wall member with a group of graphite floor members arranged to define a central aperture therein, said method comprising the steps of a. loading a container with refractory material, b. pushing said loaded container on track members beneath the opening in the floor members of said furnace chamber, c. lifting said loaded container sufficiently far to embed said depending skirt member into said refractory material to seal said furnace chamber, d. heating said refractory material to form a refractory ingot, e. lowering said container onto said tracks, f. and pushing said container on said tracks out from under said furnace.

18. A method as defined in claim 17 including the additional step of maintaining a positive pressure within said furnace chamber during the heating of said refractory material.

19. A method as defined in claim 17 including the additional step of venting said furnace chamber with one or more tubular vent members and providing means for weighting closure flap members on said tubular vent members.

* * * * *